US006948280B2

(12) United States Patent
Marcinkowski et al.

(10) Patent No.: US 6,948,280 B2
(45) Date of Patent: Sep. 27, 2005

(54) ASSEMBLEABLE AND TOWABLE/ TRAILERABLE ICE FISHING SHANTY/ HUNTING BLIND

(76) Inventors: Dave Marcinkowski, 35583 Remington Dr., Sterling Heights, MI (US) 48310; Mary Marcinkowski, 35583 Remington Dr., Sterling Heights, MI (US) 48310

( * ) Notice: Subject to any disclaimer, the term of this patent is extended or adjusted under 35 U.S.C. 154(b) by 194 days.

(21) Appl. No.: 10/354,539

(22) Filed: Jan. 30, 2003

(65) Prior Publication Data

US 2003/0140573 A1 Jul. 31, 2003

Related U.S. Application Data

(60) Provisional application No. 60/352,834, filed on Jan. 30, 2002.

(51) Int. Cl.[7] ..... E04H 9/00

(52) U.S. Cl. ..... 52/79.1; 52/70; 52/71; 52/79.5; 52/589.1; 446/478

(58) Field of Search ..... 52/79.1, 71, 70, 52/79.5, 589.1, 591.1, 624, 747, 593, 592.1, 78.1, 795.1, 589; 446/102, 69, 478, 476; 542/71

(56) References Cited

U.S. PATENT DOCUMENTS

| | | | | | |
|---|---|---|---|---|---|
| 1,141,808 | A | * | 6/1915 | McGinley | 52/66 |
| 1,721,198 | A | * | 7/1929 | Athey | 135/149 |
| 2,473,076 | A | | 6/1949 | Scheibner | 296/1 |
| 2,546,588 | A | | 3/1951 | Ellis | 280/20 |
| 3,507,293 | A | | 4/1970 | Du Bray | 135/4 |
| 3,739,536 | A | | 6/1973 | Ward | 52/63 |
| 3,820,805 | A | | 6/1974 | Tuomala | 280/12 S |
| 3,826,270 | A | | 7/1974 | Hentges | 135/4 R |
| 3,854,746 | A | | 12/1974 | Flynn et al. | 280/12 S |
| 3,971,395 | A | | 7/1976 | Lipinski | 135/4 R |
| 4,040,227 | A | * | 8/1977 | VAN DER Lely et al. | 52/745.03 |
| 4,067,165 | A | | 1/1978 | Timmons | 52/585 |
| 4,109,427 | A | * | 8/1978 | O'Brian et al. | 52/58 |
| 4,438,940 | A | | 3/1984 | Hunt | 280/12 S |
| 4,584,805 | A | * | 4/1986 | Meiry | 52/264 |
| 4,796,649 | A | | 1/1989 | Tolomay | 135/102 |
| 4,926,893 | A | | 5/1990 | Klopfenstein et al. | 135/106 |
| 4,938,243 | A | | 7/1990 | Foster | 135/105 |
| 5,107,639 | A | * | 4/1992 | Morin et al. | 52/71 |
| 5,205,088 | A | * | 4/1993 | Mueller | 52/24 |
| 5,271,423 | A | | 12/1993 | Eychaner | 135/106 |
| 5,341,588 | A | | 8/1994 | Lizotte | 43/1 |
| 5,368,057 | A | | 11/1994 | Lubkeman et al. | 135/133 |

(Continued)

*Primary Examiner*—Daniel P. Stodola
*Assistant Examiner*—Nahid Amiri
(74) *Attorney, Agent, or Firm*—Gifford, Krass, Groh, Sprinkle, Anderson & Citkowski, P.C.

(57) ABSTRACT

A portable and assembleable enclosure having a floor constructed of a first rigid panel and a second hingedly interconnecting panel, a recessed channel extending about an outer perimeter of the floor panels. A plurality of walls are each constructed of a rigid material and exhibit an annular shaped projection along a first extending side edge. A corresponding and annular shaped recess extends along a second extending side edge and receives, in engaging fashion, a first extending side edge of a succeeding wall and so that the walls may be interconnected along opposing extending edges in addition to being secured to the floor in upwardly extending fashion from within the recessed channel. A peaked roof is constructed of a first rigid panel and a second interconnecting rigid panel and which is secured to an upper perimeter extending edge of the interconnected walls. First and second pairs of triangular shaped and hinged end panels securing to opposite ends of the peaked roof panels and to enclose the structure. The floor, walls and roof convert between a stacked and transportable configuration to an assembled configuration without the need of tools.

31 Claims, 10 Drawing Sheets

U.S. PATENT DOCUMENTS 5,487,241 A * 1/1996 Gorrell et al. ..... 52/79.1
5,609,003 A * 3/1997 Jouty ..... 52/585.1
5,622,198 A * 4/1997 Elsinger ..... 135/128
5,749,387 A 5/1998 Thompson ..... 135/146
6,012,253 A * 1/2000 Burns ..... 52/79.5
6,017,081 A * 1/2000 Colby ..... 296/173
6,021,794 A 2/2000 Guerra ..... 135/95
6,185,878 B1 2/2001 Bullard, III et al. ..... 52/79.5
6,299,011 B1 * 10/2001 Rosenfeldt ..... 220/4.29
6,357,510 B1 3/2002 Zheng ..... 160/354
6,397,870 B1 6/2002 Makedonsky et al. ..... 135/116
6,446,414 B1 9/2002 Bullard, III et al. ..... 52/764
6,701,678 B1 * 3/2004 Skov et al. ..... 52/79.9

* cited by examiner

FIG - 6
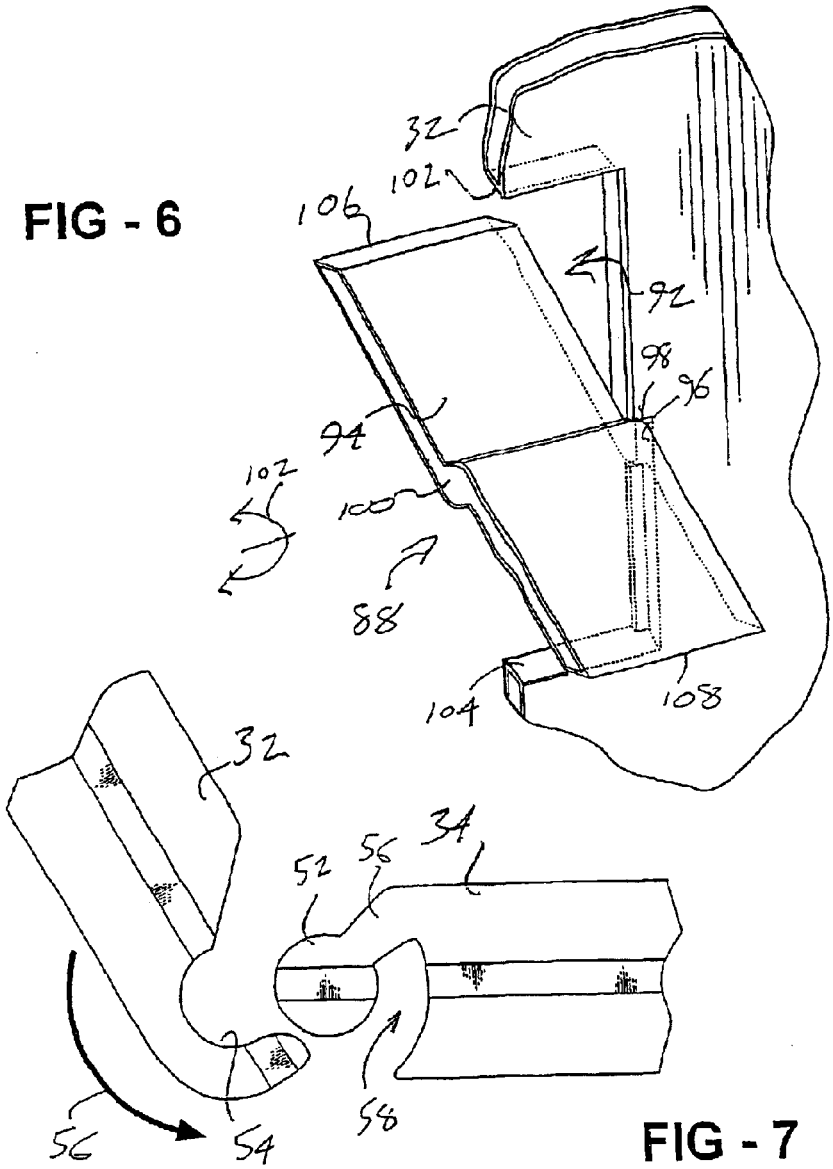
FIG - 7
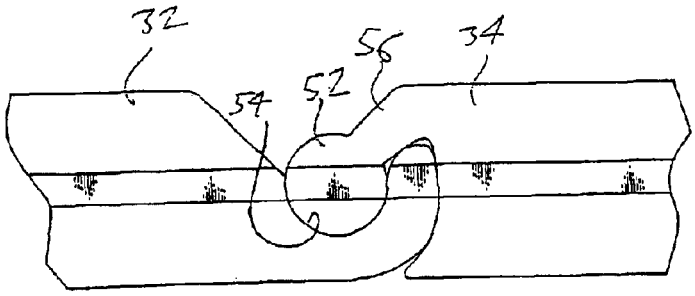
FIG - 8

ASSEMBLEABLE AND TOWABLE/ TRAILERABLE ICE FISHING SHANTY/ HUNTING BLIND

CROSS REFERENCE TO APPLICATIONS

The present invention claims the benefit of U.S. Provisional Application Ser. No. 60/352,834, filed Jan. 30, 2002, and entitled Assembleable and Trailerable Combination Shack and Ice Fishing Shanty.

BACKGROUND OF THE INVENTION

1. Field of the Invention

The present invention relates generally to portable and collapsible devices for uses including such as an ice fishing shanty. More particularly, the present invention discloses a towable/trailerable shanty device which includes a plurality of components assembleable to create an ice fishing shanty or portable hunting enclosure according to any one of a number of differently sized and shaped configurations.

2. Description of the Prior Art

The prior art is well documented with assembleable and portable enclosures for uses including such as a fishing shanty. The objective in each instance is in providing an effective enclosure device which insulates the occupants from the exterior climate effects such as the wind and cold.

A first example of the prior art is set forth in U.S. Pat. No. 3,739,536, issued to Ward, and which teaches a knock down shelter including opposite end walls each having at least one rigid panel, the lower edges of the panels being releasably received in grooves located at the front and rear, respectively, of the shelter. A plurality of elongated rail members have L-shaped angle elements at each end which detachably engage over the Lipper edges of the panels and also the vertical braces secured thereto. A canvas sheet overlies the upper edges of the panels and the rail members to form the top and side walls of the structure. The edges of the canvas are anchored by flexible ropes, and which pass through openings in the floor to enable the shelter to be used as a fish house during winter months. A hinged lid is further associated with each floor opening.

U.S. Pat. No. 5,609,003, issued to Jouty, teaches a modular construction system having a plurality of shaped building sections with spaced connecting apertures positioned along sections of the perimeter thereof, as well as providing a plurality of disconnectable fasteners and a plurality of connecting aperture plugs. The connecting apertures include two cylindrical shaped fastener bores of equal diameter intersecting at about a ninety degree angle and at a predetermined distance from an exterior opening of each of the two fastener bores.

U.S. Pat. No. 3,507,293, issued to Bray, teaches a portable and collapsible fish house including a base structure with a toboggan type bottom for ease of movement and further including a collapsible top structure which mounts thereon to provide a weather tight enclosure. The base structure further has foldable cover members which provide seat surfaces in an erected position and the top structure includes an access door for ease of usage.

Finally, U.S. Pat. No. 5,749,387, issued to Thompson, teaches a portable ice fishing hut consisting of a sturdy plastic roof and floor shells secured together by collapsible supports. The walls of the hut are manufactured from a flexible skin and the entire structure can be collapsed together for convenient storage and transport.

SUMMARY OF THE PRESENT INVENTION

The present invention is a portable and assembleable enclosure for use such as an ice fishing shanty or portable hunting blind. In particular, the present invention provides an enclosure which is capable of being quickly assembled and disassembled from a number of rigid and modular pieces in addition to being conveniently stacked for towing or trailering in the disassembled configuration.

A floor constructed of a first rigid panel and a second hingedly interconnecting panel and which are converted between a folded position when trailered/towed and an unfolded position when in use. The first and second panels each exhibit a specified shape and size and a number of removable portions are associated with each, and such as for facilitating access by occupants of the shanty to a surface of an ice covered surface of a lake or like body of water. A recessed channel extends about an outer perimeter of the hingedly connected floor panels.

A plurality of walls are provided, each of which being constructed of a rigid material and exhibiting a substantially annular shaped projection along a first extending side edge. A corresponding and substantially annular shaped recess extends along a second extending side edge of each wall and receives, in engaging fashion, a first extending side edge of a succeeding wall and so that the walls may be interconnected along opposing extending edges. The configuration of the first and second side edges, particularly in the provision of a narrowed and angled neck portion associated with the annular projection and aligning and arcuate shaped channels associated with each extending edge, facilitate rotating and engaging assembly of the wall portions and so that they define, in combination, any desired polygonal (such as rectangular) shape.

Each of the walls further includes an inner face and an outer face, a pair of spaced apart flange portions projecting from the inner face, in proximity to a bottom extending edge of the wall, and overlapping with at least one additional flange portion projecting into the recessed channel. Upon positioning the wall upon the floor in upwardly extending fashion from within the recessed channel, a pin inserts through apertures established in aligning fashion between the overlapping flanges and to secure each of the interconnected and upwardly extending walls in place.

A roof is constructed of a first rigid panel and a second interconnecting rigid panel establishing, in combination, a peaked configuration. The peaked roof panels are secured to an upper perimeter extending edge of the interconnected walls, such as again through the provision of additional overlapping flanges and engagement pins established therebetween. First and second pairs of triangular shaped and hinged end panels secure to opposite ends of the peaked roof panels and in order to enclose the structure.

BRIEF DESCRIPTION OF THE DRAWINGS

Reference will now be made to the attached drawings, when read in combination with the following detailed description, wherein like reference numerals refer to like parts throughout the several views, and in which:

FIG. 6 is a partial illustration of a selected tapered edged and pivotally secured window in an opened position and according to the present invention;

FIG. 7 is a first partial illustration of opposing wall panel edges in a first pre-assembled configuration;

FIG. 8 is a succeeding illustration to that shown in FIG. 7 and in which succeeding wall panels are illustrated in an interlocking and assembled configuration;

DETAILED DESCRIPTION OF THE PREFERRED EMBODIMENTS

Figure 1:
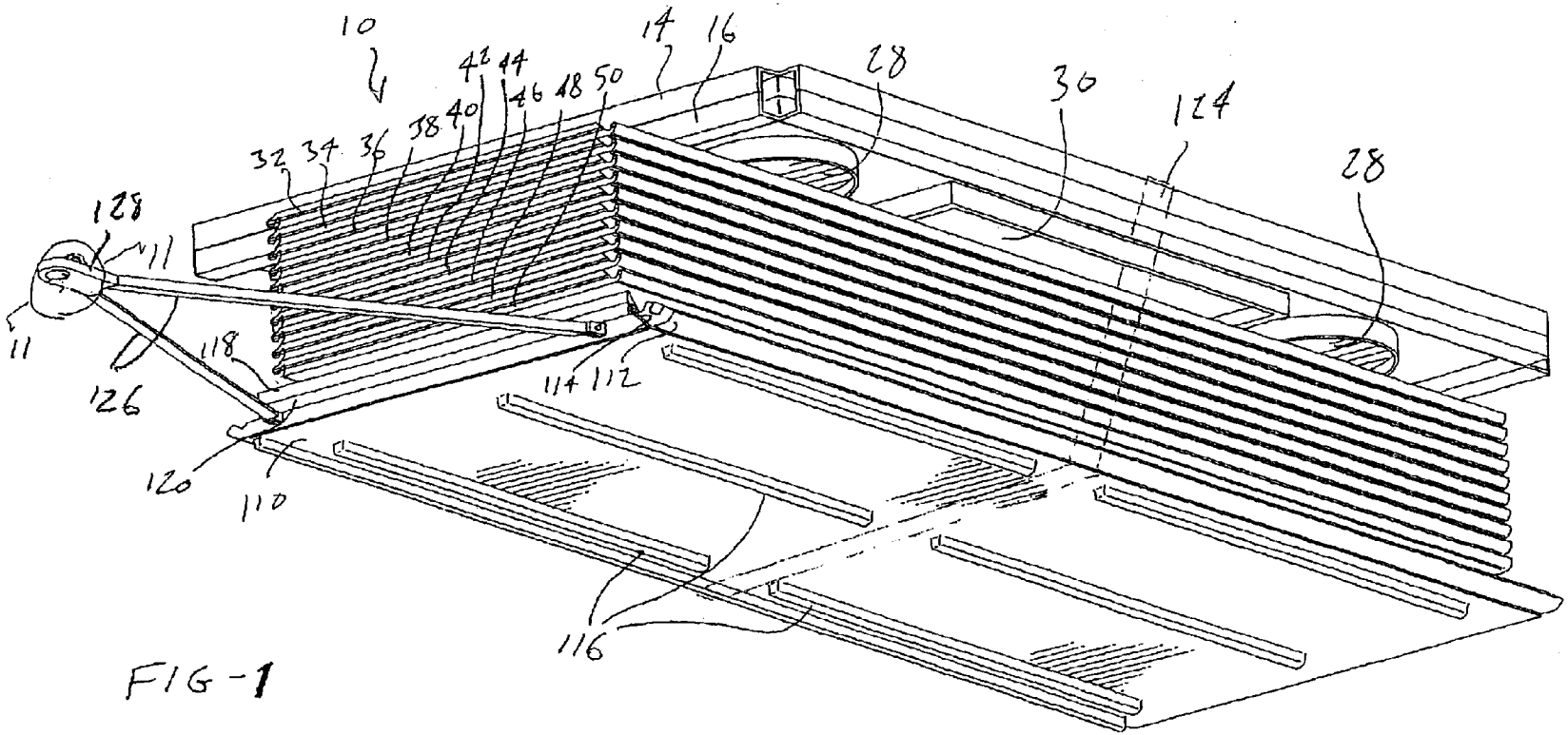
FIG. 1 is a perspective illustration of the ice fishing shanty in a collapsed and towable/trailerable configuration according to the present invention.
Figure 2:
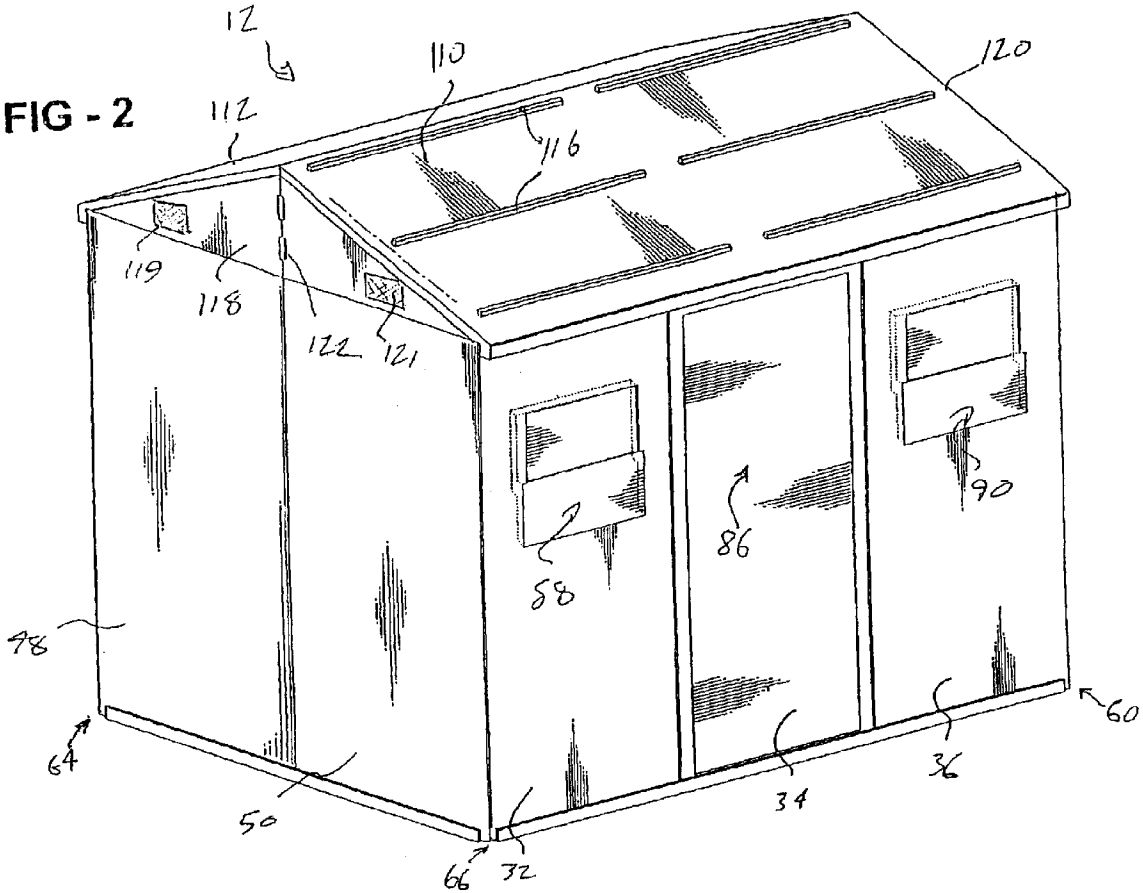
FIG. 2 is a perspective illustration of the ice fishing shanty illustrated in FIG. 1 in an assembled configuration according to the present invention.

Referring now to FIGS. 1 and 2, a portable and towable/trailerable enclosure device, such as an ice fishing shanty, is illustrated in both collapsed 10 (FIG. 1) and assembled 12 (FIG. 2) configurations according to the present invention. As previously discussed, the towable/trailerable shanty device includes a plurality of components which are assembleable, without the requirement of tools, and in order to create an ice fishing shanty or portable hunting enclosure according to any one of a number of differently sized and shaped configurations.

Referring again to FIG. 1, the collection of rigid panels which make up the assembleable shanty device are illustrated in a stacked and towable/trailerable configuration. Without limitation, each of the rigid panels, and which make up the floor, walls and roof, may be constructed of a suitable durable and insulating material, such as including a heavy duty plastic or other polymerized/resinous construction. It is also contemplated that each of the panels may include a foam insulating core to further contribute to the insulating aspects of the assembled enclosure and without sacrificing the strength and rigidity of the enclosure.

Figure 3:
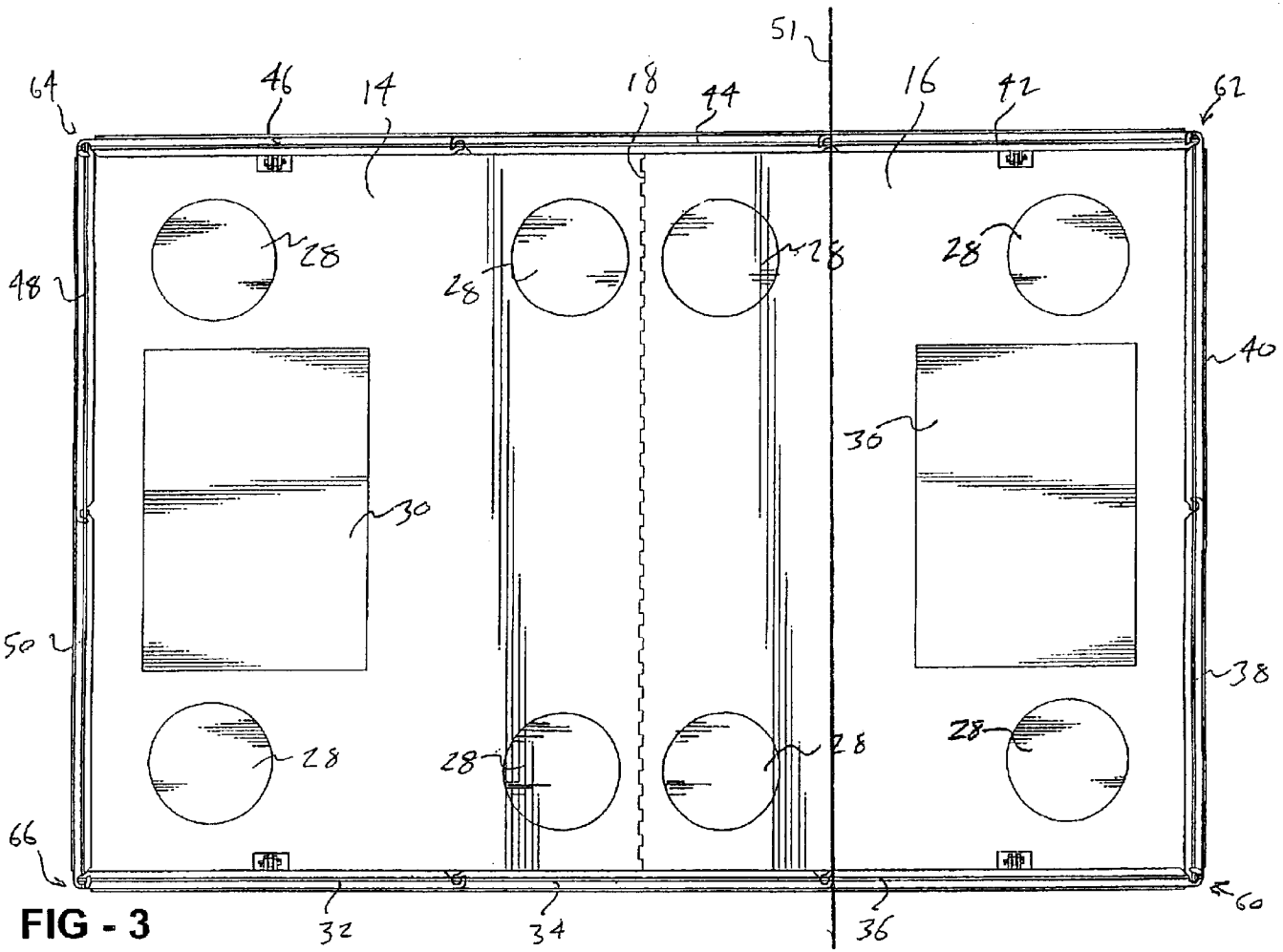
FIG. 3 is a top view illustration of the ice fishing shanty and in which the roof has been removed to illustrate the interlocking nature of the walls and floor according to the present invention.
Figure 4:
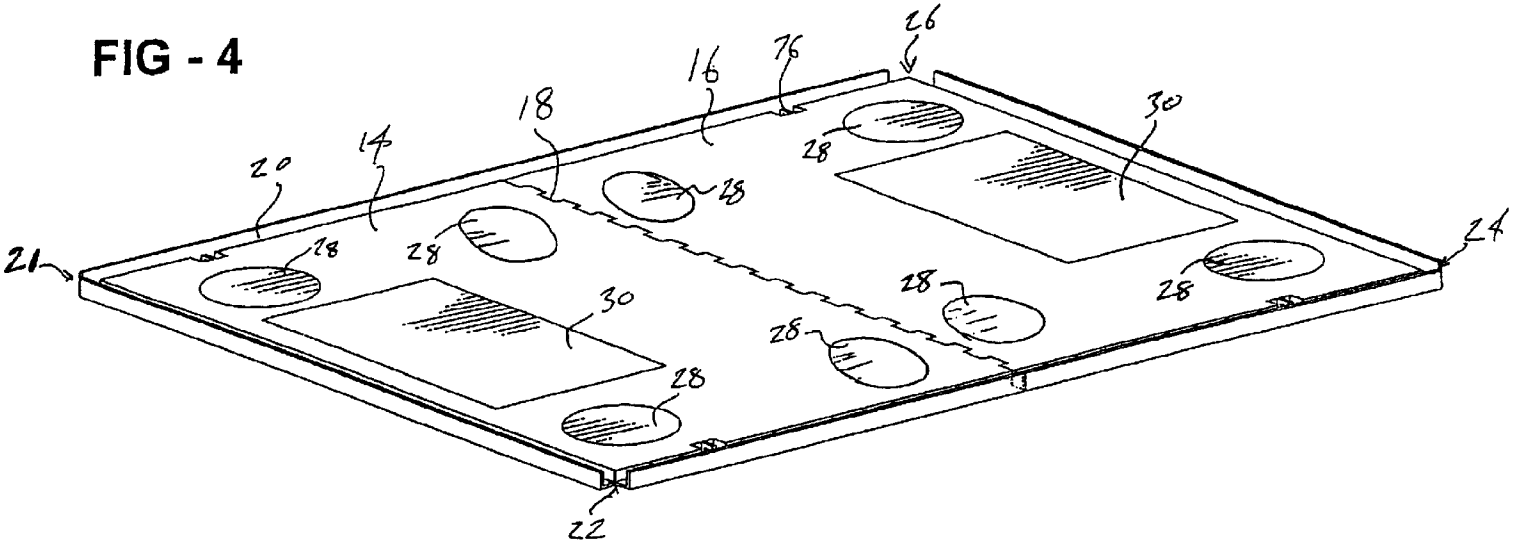
FIG. 4 is a sectional perspective of first and second hingedly disposed floor panels according to the present invention and further illustrating the removable portions and perimeter extending seating channel.

Referring to FIG. 1, in combination with FIGS. 3 and 4, a floor of the enclosure device includes a first rigid panel 14 and a second rigid panel 16 hingedly connected at 18 to the first panel 14. The panels 14 and 16 are illustrated in their stacked arrangement in FIG. 1 and in their unfolded and arrayed position in FIGS. 3 and 4. The panels 14 and 16 each exhibit a specified rectangular shape and size and, as best illustrated in FIG. 4, a recessed channel is generally illustrated at 20 in proximate extending fashion about a perimeter of the floor panels 14 and 16.

The four corner locations of the floor recess channel are opened, at 21, 22, 24 and 26 as best shown in FIG. 4, and facilitate inserting installation of the interconnecting walls as will be further described. A plurality of removable portions are also formed in the floor panels 14 and 16 and, as best again illustrated in FIGS. 3 and 4, include both rounded portions 28 and rectangular portions 30 associated with each panel. The removable portions 28 and 30 are, in a preferred variant, friction fitted to corresponding circular and rectangular outlines in the floor panels 14 and 16, it being understood that other configurations for the removable portions can be provided and further that they be additionally or alternatively attached to the floor panels through the use of fasteners, clasps or the like.

A plurality of interconnecting walls are provided and in the preferred embodiment as illustrated in reference to FIGS. 1, 2 and 3 in combination, include first 32, second 34, third 36, fourth 38, fifth 40, sixth 42, seventh 44 eighth 46, ninth 48 and tenth 50 walls. As with the hinged floor panels 14 and 16, the walls 32, 34, 36, 38, 40, 42, 44, 46, 48 and 50 have a specified shape and size and are constructed of a rigid material assembled in an overall rectangular arrangement with three interconnected walls per side and two interconnected walls per end (see again FIG. 2).

It is also understood that other sized versions of a single assembled enclosure can be provided and such may include a two wall and two wall square shaped enclosure having correspondingly smaller dimensioned floor panels, the floor panels further exhibiting a different array of removable portions in such an instance. Along these lines, and referencing again FIG. 3, line 51 represents a cut-off point for a proposed alternative variant of the invention and by which a smaller shanty enclosure exhibiting 2×2 walls is utilized in substitution of the 3×2 arrangement illustrated herein.

The wall panels 32–50 are each substantially identically constructed and, with reference to interconnecting portions of the panels 32 and 34 illustrated in FIGS. 7 and 8, each further exhibits a substantially annular shaped projection, see for example at 52 for wall panel 34, along a first extending side edge. A corresponding and substantially annular shaped recess, see further by example at 54 for panel 32, extends along a second extending side edge and receives, in rotative engaging fashion (see arrow 56 in FIG. 7), a first extending side edge of a succeeding wall.

Each of the walls further includes a narrowed neck portion configured along the first extending side edge (see for example again at 56 for first associated edge of wall 34 in FIGS. 7 and 8) and for arraying the associated annular shaped projection 52 in an angled edge extending fashion. An arcuate channel (see at 58 for panel 34 in FIG. 7) is configured along the first extending side edge, in contact with the neck portion 56, and facilitates rotating and engaging assembly of the succeeding wall unit (in this case wall 32) as again illustrated in FIGS. 7 and 8 and in order to interlockingly assemble together the two wall units 32 and 34. The configuration of the interlocking annular projections and annular recesses is further such that the individual walls can be assembled together in any desired and polygonal shaped fashion, such as again referenced by the rectangular arrangement of FIGS. 2 and 3 and to take into account both straight end-to-end connections (see again FIGS. 7 and 8) as well as corner connections (see further at 60, 62, 64 and 66 in the top cutaway of FIG. 3 and assembled perspective of FIG. 2). As previously noted, the corner openings in the perimeter extending recessed channel accommodate the angled connections between the succeeding walls and in the maimer best illustrated in the top cutaway of FIG. 3.

Figure 5:
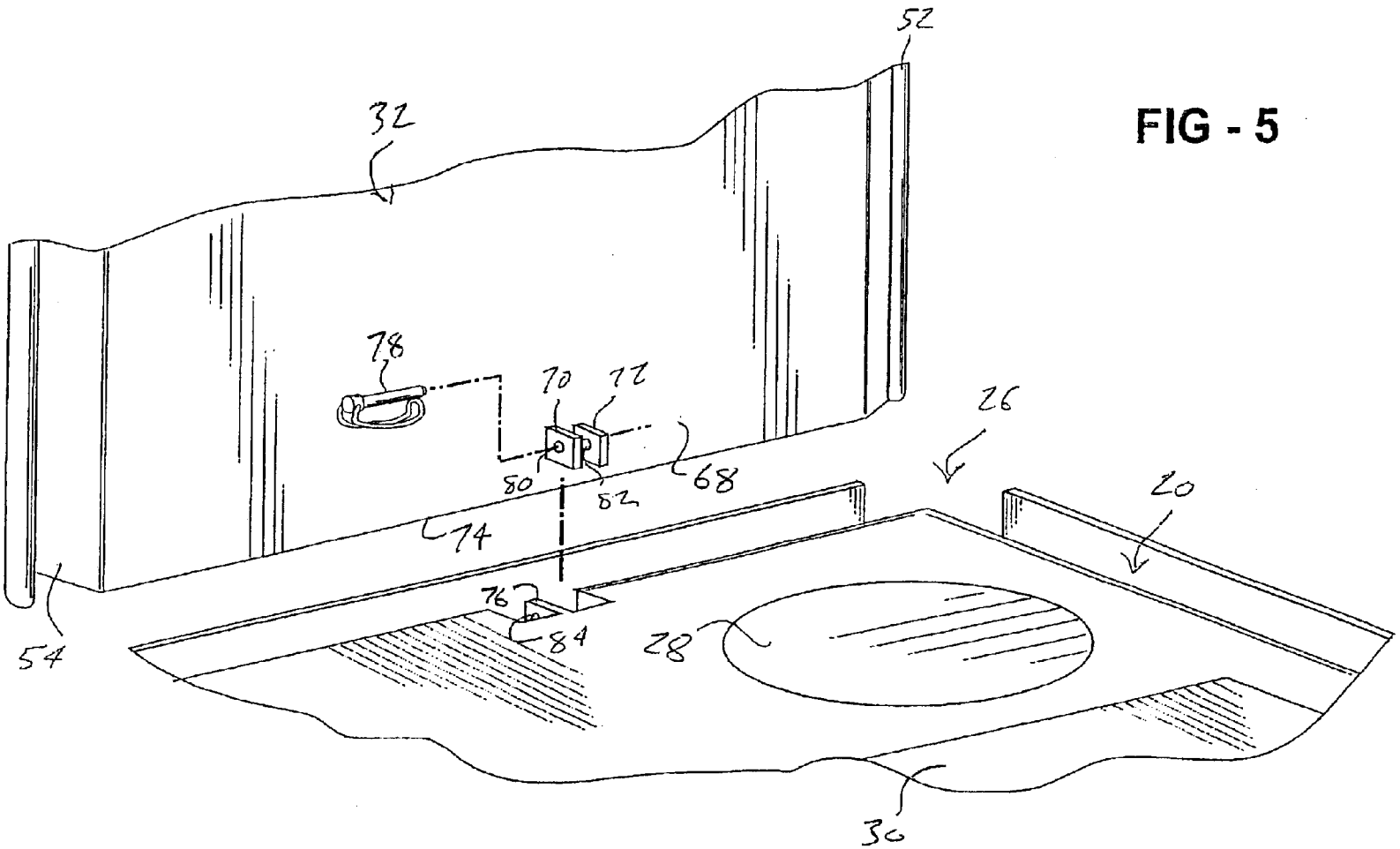
FIG. 5 is an enlarged perspective illustration of a pin and flange arrangement for securing a lower edge of a selected wall panel along a selected perimeter extending location of the floor and encircling channel according to the present invention.

Referencing in particular the partially exploded view of FIG. 5, each of the walls (and illustrating by example wall 32) further includes an inner face 68 (as well as a corresponding outer face). At pair of spaced apart flange portions 70 and 72 project from the inner face 68, in proximity to a bottom extending edge 74 of the wall 32, and to overlap (or sandwich therebetween) an additional flange portion 76 projecting into the recessed channel upon positioning the wall 32 upon the floor. A pin 78 inserts through apertures 80, 82 and 84 established in aligning fashion between the overlapping flanges (see again FIG. 5) and in order to secure and support each associated wall 32–50 in upwardly extending fashion from the floor panels 14 and 16 and upon the walls being interconnected together in the maimer particularly illustrated in FIGS. 7 and 8.

Figure 5A:
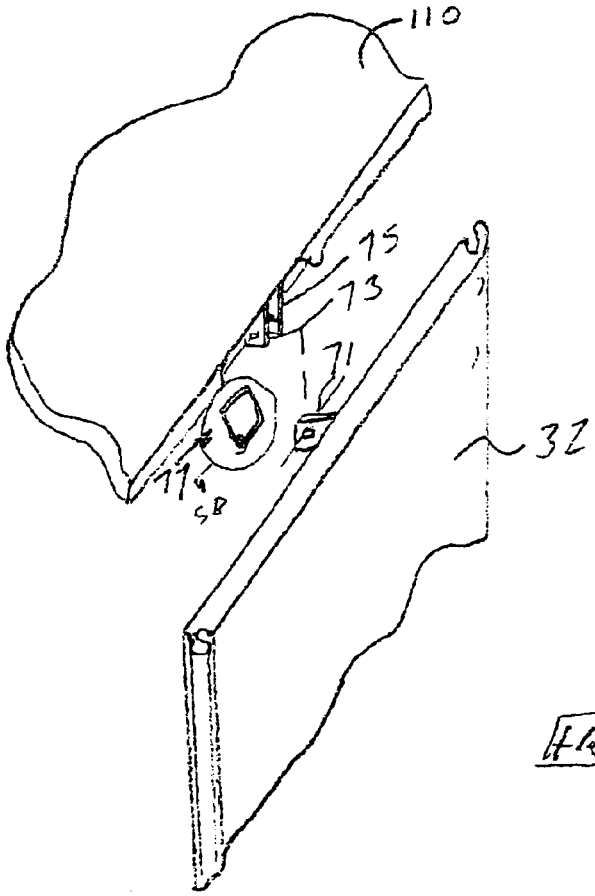
FIG. 5A is a perspective view in cutaway of a selected connection between an upper extending end of a wall panel and an associated lower edge location of an inter-engaging roof panel.

Referring now to FIG. 5A, an illustration is shown of a selected upper end connection between a selected wall, again wall 32, and an adjoining edge of a roof panel, identified subsequently at 110. In particular, a flange 71 extends from a proximate upper edge location of the wall panel 32 and is arranged so as to matingly receive between an additional pair of flanges 73 and 75 extending from proximate edge locations of an associated roof panel.

Figure 5B:
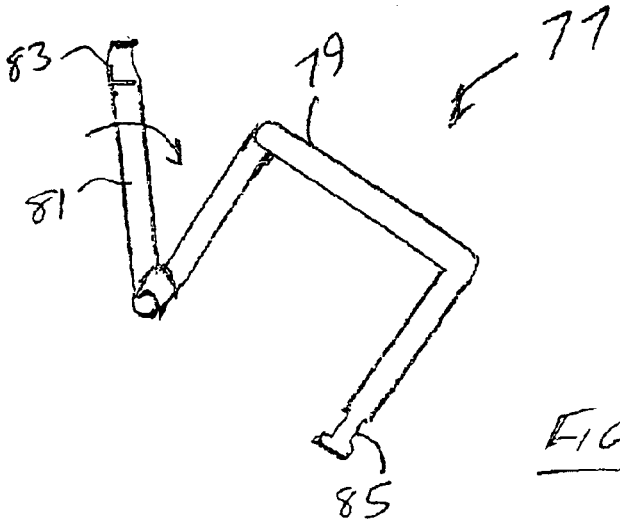
FIG. 5B is a partial view of a selected connector for use in the wall panel to roof connection referenced in FIG. 5A.

As further illustrated in FIG. 5A, and referencing further FIG. 5B, a modified pin assembly 77 is shown and which includes a substantially "U" shaped body 79 which is configured to fit through the overlapping and mating apertures defined in the flanges 71 and 73 & 75. A clasp portion 81 rotatably attaches to one end of the "U" shaped body 79 and is rotated to a closed position in which an associated end 83 of the rotatable clasp portion 81 engages a suitable catch portion 85 located on the opposite extending end of the "U" shaped body 79.

Figure 5C:
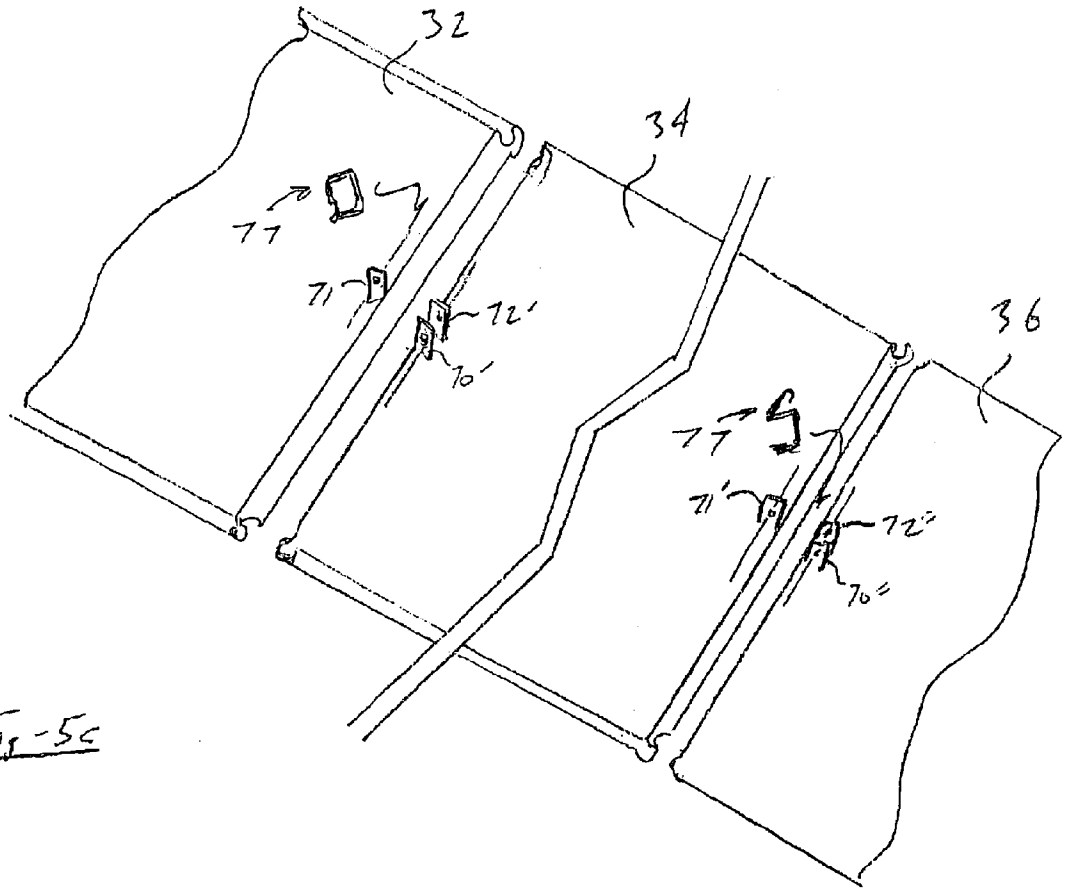
FIG. 5C is a further perspective view in cutaway of a plurality of wall panels, secured in end-to-end fashion and in order to assemble an emergency and buoyant walkway according to the present invention.

Referring further to FIG. 5C, an illustration is provided of another safety feature of the ice shanty assembly, that being the ability to quickly assemble a highly buoyant and extendable walkway surface such as in instances of individuals falling through a break in an ice covered surface upon which the ice shanty is located. In this illustration, a series of the wall panels 32, 34 and 36 are illustrated, each in reduced length. It is envisioned that the wall panels are located in top to bottom opposing fashion and such that the single flange 71 of wall 32 is located in mating (and slightly spaced fashion) relative to flanges 70' and 72' associated with the succeeding wall panel 34. The opposite end of the panel 34 likewise includes a single extending flange 71' which is likewise arranged in opposing and mating fashion with a yet additional pair of flanges 70" and 72" associated with the succeeding wall panel 36.

Pin assemblies 77, as previously described in FIGS. 5A and 5B, are employed for interconnecting each opposing flange arrangement of FIG. 5C, it being understood that the "U" shaped configuration of each pin assembly 77 permits it to engage all three flanges in each opposing assembly and considering that flanges apertures in this arrangement will not be aligned as in the normal engaging illustrations of FIGS. 5 and 5A. In this fashion, an elongated walkway can be quickly assembled and extended such as over open water established by a break in the ice covered surface and in order to establish a safety bridge for use in rescuing persons who have fallen into the water.

Referring to FIG. 2, at least one of the interconnecting walls may include a door and such as is referenced at 86 for interconnecting wall member 34. Additional walls further exhibit therein a window and as such is further referenced at 88 (for wall 32) and at 90 (for wall 34).

Referring further to FIG. 6, selected window unit 88 is illustrated in combination with partially cut-away wall unit 32 and which further exhibits an interior and polygonal shaped, preferably rectangular, enclosure 92. A planar shaped member 94, generally equal in area to the surrounding enclosure 92, overlays the enclosure and is pivotally secured to the selected wall 32 at an intermediate location 96. In particular, a recess or notch is defined in each of opposing side edges of the enclosure walls, see at 98, and so that an enlarged and arcuate central width-wise extending portion 100 of the planar shaped member 94 is rotatable between a first open position and a second closed position (see further rotating arrow 102 in FIG. 6).

To further facilitate sealed closing of the pivoting window a pair 102 and 104 of the opposing and inwardly facing edges of the enclosure 92 exhibit a taper. Corresponding and outwardly facing edges 106 and 108 of the pivoting and planar shaped member exhibit a reciprocally shaped taper for both seating and sealing said pivotally secured member within the enclosure in the closed position.

Referring again to FIGS. 1 and 2, a pair of first 110 (as previously illustrated in FIG. 5A) and second 112 rigid panels are provided and which are interconnected together along a common edge in an assembled configuration so as to create a peaked roof for the enclosure. As illustrated, the first 110 roof panel exhibits an open and extending side edge (see at 114 in FIG. 1) and which reveals a substantially hollow interior for receiving, in slidably inserting fashion, the other selected roof panel 112 in the transportable configuration. A plurality of elongate projecting stand-off portions are illustrated at 116, associated with a given facing surface of the roof panel 110, and facilitate towing upon such as an ice covered surface in the transportable configuration.

As described previously in FIGS. 5A and 5B, the peaked roof panels 110 and 112 are secured to an upper perimeter extending edge of the interconnected walls 32–50, such as again through the provision of the additional overlapping flanges and "U" shaped engagement pins 77 established therebetween. It is further contemplated that the "U" shaped configuration of the wall to ceiling pins 77 assist in further preventing the roof from being lifted off of the enclosure.

First and second pairs of triangular shaped and hinged end panels, see at 118 and 120, are provided and are illustrated both in the assembled view of FIG. 2 and the stacked configuration of FIG. 1. These pairs of end panels, as best illustrated by selected end panel 118 in FIG. 2, includes a central hinge 122 and by which the end panels may be folded into the stowed configuration of FIG. 1, as well as unfolded and engaged in the manner illustrated in FIG. 2 and so that they, in combination with the peaked roof panels 110 and 112, enclose the assembled structure.

It is also understood that the end panels can be constructed of a Plexiglas or any other suitable material and may further be ventilated, such as by the placement of screens 119 and 121 (see FIG. 2) at selected locations in the end panels, e.g. again at 118. In this manner, the enclosed assembly is properly ventilated and in order to prevent such as carbon monoxide poisoning resulting from the occupants of the shanty using a propane heating device.

Referring again to FIG. 1, a strap 124 or other suitable band may be secured about the stacked floor, wall and roof panels and, in combination with a trailer band 126 and hitch portion 128, provide for transport of the assembleable device and such as over a snow or ice covered surface. In this manner, the device may be most efficiently transported to a remote location (such as again an ice covered body of water) and subsequently assembled in the manner described herein.

Figure 10:
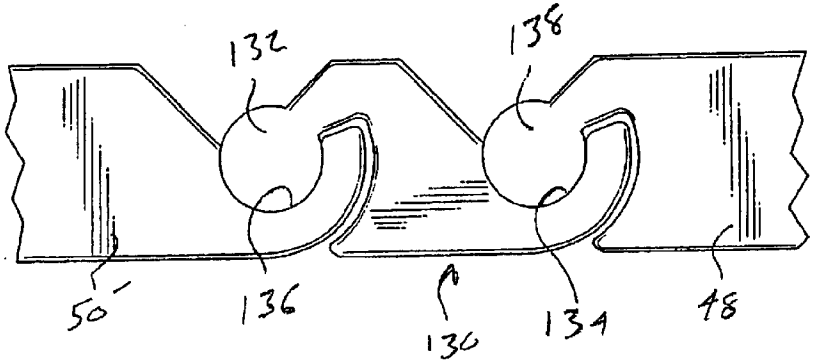
FIG. 10 is a cutaway view taken along line 10—10 of FIG. 9 and illustrating, in side profile, a selected and elongated coupler for interconnecting first and second assembled structures according to the present invention.
Figure 9:
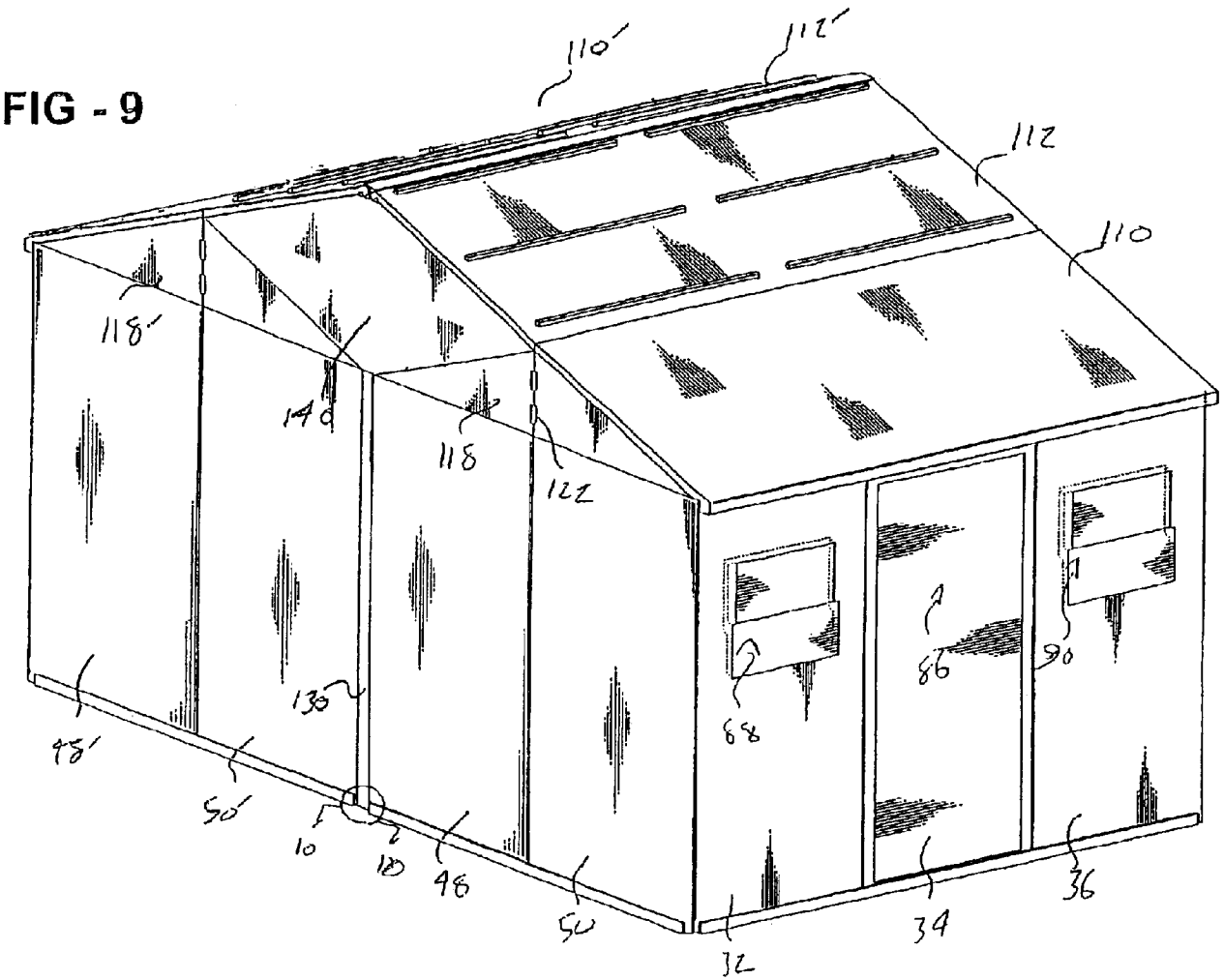
FIG. 9 is an assembled configuration, similar to that shown in FIG. 2, and by which first and second structures are assembled in an interconnecting and combined enclosing manner according to the present invention.

Referring to FIGS. 9 and 10 in combination, additional structure is disclosed for interengaging two substantially assembled enclosures, as previously described herein, and in order to create a larger overall structure. In particular, and looking at the cutaway view of FIG. 10, a first 130 of a pair of elongated couplers is illustrated, and includes an annular shaped projection 132 along one extending edge and an annular shaped recess 134 along an opposite extending edge.

The projecting 132 and recessed 134 edges correspond to the opposite edge configurations of each of the interconnecting walls (reference again is made to FIGS. 7 and 8) and whereby the couplers (see again at 130 in FIG. 9) interengage spaced apart side wall edges associated with the first and second substantially assembled enclosures and in order to create an enlarged enclosure. In particular, and referencing again FIG. 10, the annular projection 132 interengages a recessed 136 edge associated with an edge-most extending wall panel 50' drawn from the second substantially completed enclosure (again FIG. 9), whereas the annular recess 134 engages an annular projection 138 extending from a corresponding wall 48 from the first substantially completed enclosure.

As best again shown in FIG. 9, a pair of substantially diamond shaped enclosures, see for example at 140, are provided for enclosing the central location associated with each of the roofs and in particular panels 110 & 112 and 110' & 112' associated with each of the first and second enclosures, as well as associated hinged end panels 118 and 118'. As is also understood, the pairs of roof panels 110 & 112 and 110' and 112' are capable of being arranged in a planar arrayed (and as opposed to peaked) fashion and in order to configure a larger peaked enclosure as illustrated in FIG. 9.

Figure 11:
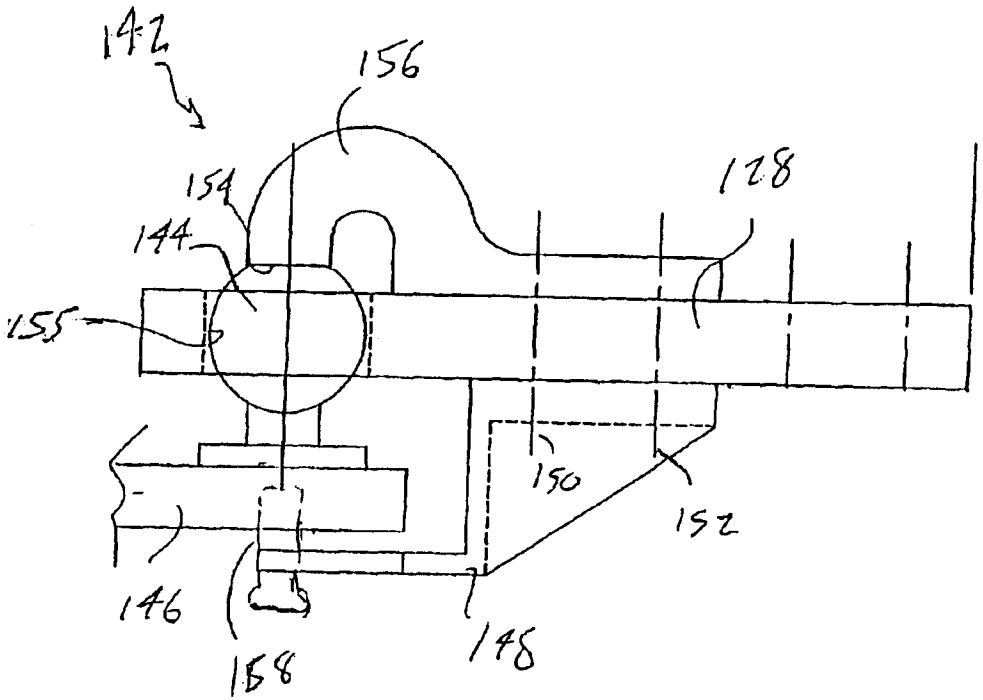
FIG. 11 is a side view illustration of the tow connector, as also shown in FIG. 1, in combination with an inter-engaging vehicle hitch according to the present invention.

Referring finally to FIG. 11, an illustration is shown at 142 of the hitch portion 128 engaged by a ball 144 extending from a tow vehicle support 146. In this illustration, a plastic support 148 extends from an underside location of the hitch portion 128, in the general shape of a bracket, and which is secured at locations 150 and 152 by screws to the hitch portion 128. An upper end of the ball 144 is seated, at 154, against a corresponding downward facing surface of an arcuately configured support 156 associated with the hitch portion 128 and in addition to an inner annular surface 155 associated with the hitch portion 128 through which the ball 144 seats.

The purpose of the arrangement 142 is to achieve a reinforcing plastic to metal connection between the hitch ball 144 and the hitch portion 128. Accordingly, and by fastening the tow vehicle support 146 to an extending edge of the extending plastic support 148 by a screw or fastener 158, this enables much of the wearing forces to be drawn away from the ball 144 and seating surfaces 154 and 155, and to the metal support 146 to plastic support 148 (again by virtue of the fastener 158). In this manner, a mechanical failure in the hitch assembly will result in a less expensive part replacement.

Having described our invention, other and additional embodiments are contemplated within the scope of the present invention. In particular, and as previously stated, the assembleable enclosure can be constructed with any varying number, or configuration, floor, wall and roof panels and in order to achieve any of a variety of different configurations, these including any other polygonal shaped enclosures (for example, five-sided, six-sided, etc.). Also, it is contemplated that the interconnecting combination of any plurality of substantially constructed enclosures (beyond the two illustrated in FIG. 9) are possible within the scope of the invention.

Other and additional features will also become apparent within the scope of the invention and in reference to the appended claims.

We claim:

1. A portable and assembleable enclosure, comprising:

a floor constructed of at least one rigid panel having a specified shape and size, a recessed channel extending about an outer perimeter of said at least one panel;

a plurality of walls, each of which being constructed of a rigid material and configured so that said walls may be interconnected along opposing extending edges as well as being secured to said floor in upwardly extending fashion from within said recessed channel;

each of said walls further comprising an inner face and an outer face, at least one flange portion projecting from said inner face, in proximity to a bottom extending edge of said wall, and overlapping with at least one additional flange portion projecting into said recessed channel upon positioning said wall upon said floor; and a roof constructed of at least one rigid panel and which is secured to an upper perimeter extending edge of said interconnected walls;

said floor, walls and roof converting between a stacked and transportable configuration to an assembled configuration.

2. The enclosure as defined in claim 1, said floor further comprising a first rigid panel and a second hingedly interconnecting panel.

3. The enclosure as defined in claim 2, at least one of said floor panels further comprising a plurality of removable portions.

4. The enclosure as defined in claim 1, said roof further comprising a first rigid panel and a second interconnecting panel establishing, in combination, a peaked configuration.

5. The enclosure as defined in claim 4, a first selected one of said roof panels exhibiting an open and extending side edge revealing a substantially hollow interior and for receiving, in slidably inserting fashion, the other selected roof panel in said transportable configuration.

6. The enclosure as defined in claim 4, further comprising first and second pairs of triangular shaped and hinged end panels which, in combination with said peaked roof panels, enclose said assembled structure.

7. The enclosure as defined in claim 1, each of said interconnecting walls exhibiting a substantially annular shaped projection along a first extending side edge, a corresponding and substantially annular shaped recess extending along a second extending side edge and receiving, in engaging fashion, a first extending side edge of a succeeding wall.

8. The enclosure as defined in claim 7, each of said walls further comprising a narrowed neck portion configured along said first extending side edge and for arraying said associated annular shaped projection in an angled edge extending fashion.

9. The enclosure as defined in claim 8, an arcuate channel being configured along said first extending side edge, in contact with said neck portion, and facilitating rotating and engaging assembly of a succeeding wall.

10. The enclosure as defined in claim 7, further comprising a pair of elongated couplers, each of which including an annular shaped projection along one extending edge and an annular shaped recess along an opposite extending edge, said couplers interengaging spaced apart side wall edges associated with first and second substantially assembled enclosures and in order to create an enlarged enclosure.

11. The enclosure as defined in claim 1, further comprising a pin inserting through apertures established in aligning fashion between said overlapping flanges.

12. The enclosure as defined in claim 11, further comprising a pair of spaced apart flanges projecting from a first selected one of said side wall inner face and said floor, a single flange projecting from a further selected one of said wall and said floor, in sandwiching fashion between said pair of spaced apart flanges, and receiving therethrough said pin.

13. The enclosure as defined in claim 1, further comprising a plurality of eight interconnected walls separated into sides of three interconnected walls and ends of two interconnected walls.

14. The enclosure as defined in claim 1, at least one first selected and interconnected wall exhibiting a door, at least one second selected wall exhibiting a window.

15. The enclosure as defined in claim 14, said at least one second selected wall further exhibiting an interior and polygonal shaped enclosure, a planar shaped member, generally equal in area to said enclosure and overlaying said enclosure, being pivotally secured to said selected wall at an intermediate location and rotatable between a first open position and a second closed position.

16. The enclosure as defined in claim 1, further comprising a hitch portion for assisting in towing said enclosure in said transportable configuration.

17. The enclosure as defined in claim 16, further comprising a plastic support extending from an underside location of said hitch portion, a hitch ball seating, at an upper end thereof, against a corresponding downward facing surface of an arcuately configured support associated with said hitch portion and in addition to said ball seating in inserting fashion against an inner annular surface associated with said hitch portion, said plastic support affixing to an extending tow vehicle support to reduce wear forces occurring between said ball and said hitch portion.

18. The enclosure as defined in claim 1, further comprising open corner locations of said floor in communication with said recessed channel.

19. The enclosure as defined in claim 1, further comprising a plurality of elongate projecting stand-off portions associated with a given facing surface of said roof and to facilitate towing upon such as an ice covered surface in said transportable configuration.

20. The enclosure as defined in claim 1, each of said walls further comprising an inner face and an outer face, at least one flange portion projecting from said inner face, in proximity to a top extending edge of said wall, and overlapping with at least one additional flange portion projecting from an adjoining location of said roof panel.

21. The enclosure as defined in claim 20, further comprising a substantially "U" shaped pin inserting through apertures established in spaced apart and proximately located fashion between said flanges.

22. The enclosure as defined in claim 21, further comprising a pair of spaced apart flanges projecting from said roof panel, a single flange projecting from said wall and receiving therethrough said "U" shaped pin.

23. The enclosure as defined in claim 22, further comprising a plurality of "U" shaped pins engageable with top and bottom flanges associated with said plurality of walls, and upon said walls being interconnected in end-to-end extending fashion to construct a buoyant bridge.

24. A portable and assembleable enclosure, comprising:

a floor constructed of at least one rigid panel having a specified shape and size, a recessed channel extending about an outer perimeter of said at least one panel;

a plurality of walls, each of which being constructed of a rigid material and configured so that said walls may be interconnected along opposing extending edges as well as being secured to said floor in upwardly extending fashion from within said recessed channel;

at least one first selected and interconnected wall exhibiting a door, at least one second selected wall exhibiting a window, said at least one second selected wall further exhibiting an interior and polygonal shaped enclosure, a planar shaped member, generally equal in area to said enclosure and overlaying said enclosure, being pivotally secured to said selected wall at an intermediate location and rotatable between a first open position and a second closed position; and a roof constructed of at least one rigid panel and which is secured to an upper perimeter extending edge of said interconnected walls;

said floor, walls and roof converting between a stacked and transportable configuration to an assembled configuration.

25. The enclosure as defined in claim 24, further comprising a pair of opposing and inwardly facing edges of said polygonal shaped enclosure exhibiting a taper, corresponding and outwardly facing edges of said planar shaped member exhibiting an reciprocally shaped taper for both seating and sealing said pivotally secured member within said enclosure in said closed position.

26. A portable and assembleable enclosure, comprising:

a floor constructed of a first rigid panel and a second hingedly interconnecting panel, said first and second panels each having a specified shape and size, a recessed channel extending about an outer perimeter of said panels;

at least one of said first and second floor panels further comprising a plurality of removable portions;

a plurality of walls, each of which being constructed of a rigid material and exhibiting a substantially annular shaped projection along a first extending side edge, a corresponding and substantially annular shaped recess extending along a second extending side edge and receiving, in engaging fashion, a first extending side edge of a succeeding wall and so that said walls may be interconnected along opposing extending edges as well as being secured to said floor in upwardly extending fashion from within said recessed channel; and a roof constructed of a first rigid panel and a second interconnecting rigid panel establishing, in combination, a peaked configuration and which is secured to an upper perimeter extending edge of said interconnected walls, first and second pairs of triangular shaped and hinged end panels securing to opposite ends of said peaked roof panels to enclose said structure;

said floor, walls and roof converting between a stacked and transportable configuration to an assembled configuration.

27. A portable and assembleable enclosure, comprising:

a floor constructed of a first rigid panel and a second hingedly interconnecting panel, said first and second panels each having a specified shape and size, a recessed channel extending about an outer perimeter of said panels;

a plurality of walls, each of which being constructed of a rigid material and exhibiting a substantially annular shaped projection along a first extending side edge, a corresponding and substantially annular shaped recess extending along a second extending side edge and receiving, in engaging fashion, a first extending side edge of a succeeding wall and so that said walls may be interconnected along opposing extending edges;

each of said walls further comprising an inner face and an outer face, at least one flange portion projecting from said inner face, in proximity to a bottom extending edge of said wall, and overlapping with at least one additional flange portion projecting into said recessed channel upon positioning said wall upon said floor in upwardly extending fashion from within said recessed channel, a pin inserting through apertures established in aligning fashion between said overlapping flanges; and a roof constructed of a first rigid panel and a second interconnecting rigid panel establishing, in combination, a peaked configuration and which is secured to an upper perimeter extending edge of said interconnected walls by additional overlapping flanges and engagement pins established therebetween, first and second pairs of triangular shaped and hinged end panels securing to opposite ends of said peaked roof panels to enclose said structure;

said floor, walls and roof converting between a stacked and transportable configuration to an assembled configuration.

28. A portable and assembleable enclosure, comprising:

a floor constructed of at least one rigid panel having a specified shape and size, a recessed channel extending about an outer perimeter of said at least one panel;

a plurality of walls, each of which being constructed of a rigid material and configured so that said walls may be interconnected along opposing extending edges as well as being secured to said floor in upwardly extending fashion from within said recessed channel; and a roof constructed of at least one rigid panel and which is secured to an upper perimeter extending edge of said interconnected walls, said roof further comprising a first rigid panel and a second interconnecting panel establishing, in combination a peaked configuration, a first selected one of said roof panels exhibiting an open and extending side edge revealing a substantially hollow interior and for receiving, in slidably inserting fashion, the other selected roof panel in said transportable configuration;

said floor, walls and roof converting between a stacked and transportable configuration to an assembled configuration.

29. A portable and assembleable enclosure, comprising:

a floor constructed of at least one rigid panel having a specified shape and size, a recessed channel extending about an outer perimeter of said at least one panel;

a plurality of walls, each of which being constructed of a rigid material and configured so that said walls may be interconnected along opposing extending edges as well as being secured to said floor in upwardly extending fashion from within said recessed channel;

each of said interconnecting walls exhibiting a substantially annular shaped projection along a first extending side edge, a corresponding and substantially annular shaped recess extending along a second extending side edge and receiving, in engaging fashion, a first extending side edge of a succeeding wall;

a pair of elongated couplers, each of which including an annular shaped projection along one extending edge and an annular shaped recess along an opposite extending edge, said couplers interengaging spaced apart side wall edges associated with first and second substantially assembled enclosures and in order to create an enlarged enclosure; and a roof constructed of at least one rigid panel and which is secured to an upper perimeter extending edge of said interconnected walls;

said floor, walls and roof converting between a stacked and transportable configuration to an assembled configuration.

30. A portable and assembleable enclosure, comprising:

a floor constructed of at least one rigid panel having a specified shape and size, a recessed channel extending about an outer perimeter of said at least one panel;

a plurality of walls, each of which being constructed of a rigid material and configured so that said walls may be interconnected along opposing extending edges as well as being secured to said floor in upwardly extending fashion from within said recessed channel;

a roof constructed of at least one rigid panel and which is secured to an upper perimeter extending edge of said interconnected walls;

said floor, walls and roof converting between a stacked and transportable configuration to an assembled configuration; and a hitch portion for assisting in towing said enclosure in said transportable configuration, a plastic support extending from an underside location of said hitch portion, a hitch ball seating, at an upper end thereof, against a corresponding downward facing surface of an arcuately configured support associated with said hitch portion and in addition to said ball seating in inserting fashion against an inner annular surface associated with said hitch portion, said plastic support affixing to an extending tow vehicle support to reduce wear forces occurring between said ball and said hitch portion.

31. A portable and assembleable enclosure, comprising:

a floor constructed of at least one rigid panel having a specified shape and size, a recessed channel extending about an outer perimeter of said at least one panel, open corner locations of said floor in communication with said recessed channel;

a plurality of walls, each of which being constructed of a rigid material and configured so that said walls may be interconnected along opposing extending edges as well as being secured to said floor in upwardly extending fashion from within said recessed channel; and a roof constructed of at least one rigid panel and which is secured to an upper perimeter extending edge of said interconnected walls;

said floor, walls and roof converting between a stacked and transportable configuration to an assembled configuration.

* * * * *